United States Patent [19]

Flaig et al.

[11] Patent Number: 5,043,647

[45] Date of Patent: Aug. 27, 1991

[54] SYSTEM AND METHOD FOR CONTROLLING THE SPEED OF A VEHICLE HAVING AN INTERNAL COMBUSTION-ENGINE

[75] Inventors: Ulrich Flaig, Markgröningen; Albrecht Sieber, Ludwigsburg, both of Fed. Rep. of Germany

[73] Assignee: Robert Bosch GmbH, Stuttgart, Fed. Rep. of Germany

[21] Appl. No.: 445,618

[22] PCT Filed: May 5, 1988

[86] PCT No.: PCT/EP88/00383

§ 371 Date: Jan. 5, 1990

§ 102(e) Date: Jan. 5, 1990

[87] PCT Pub. No.: WO89/11028

PCT Pub. Date: Nov. 16, 1989

[51] Int. Cl.[5] ..... F02D 29/02; F02D 45/00

[52] U.S. Cl. ..... 318/610; 123/352

[58] Field of Search ..... 123/350, 352; 180/170, 180/176, 177, 178, 179; 318/560, 609, 610

[56] References Cited

U.S. PATENT DOCUMENTS

| | | | |
|---|---|---|---|
| 3,060,602 | 10/1962 | Buttenhoff | 123/352 X |
| 3,870,939 | 3/1975 | Robert . | |
| 4,086,888 | 5/1978 | Roberts | 123/352 X |
| 4,188,926 | 2/1980 | Fleischer | 123/352 |
| 4,200,007 | 4/1980 | Espenschied et al. | 123/352 X |
| 4,273,208 | 6/1981 | Liermann | 123/352 X |
| 4,425,888 | 1/1984 | Engel et al. | 123/352 X |
| 4,541,052 | 9/1985 | McCulloch | 180/179 X |
| 4,852,011 | 7/1989 | Ueno | 123/352 X |

FOREIGN PATENT DOCUMENTS

| | | | |
|---|---|---|---|
| 55-19957 | 2/1980 | Japan | 123/352 |
| 57-168038 | 10/1982 | Japan | 123/352 |
| 58-222934 | 12/1983 | Japan | 123/352 |
| 59-46349 | 3/1984 | Japan | 123/352 |
| 59-126044 | 7/1984 | Japan | 180/179 |
| 60-195356 | 2/1986 | Japan . | |
| 62-191235 | 8/1987 | Japan | 180/178 |
| 1281090 | 7/1972 | United Kingdom . | |

*Primary Examiner*—Bentsu Ro

*Attorney, Agent, or Firm*—Walter Ottesen

[57] ABSTRACT

A vehicle speed control system comprises a vehicle speed controller (14) and an auxiliary engine speed controller (17) which keeps to the engine speed set by the first controller (14) and which controls the amount of fuel and/or air supplied to the vehicle engine. A comparator (13) compares actual and desired vehicle speed signals and is connected to the first controller (14), which produces a desired engine speed signal which is compared (16) with the actual engine speed signal from a sensor (21).

1 Claim, 1 Drawing Sheet

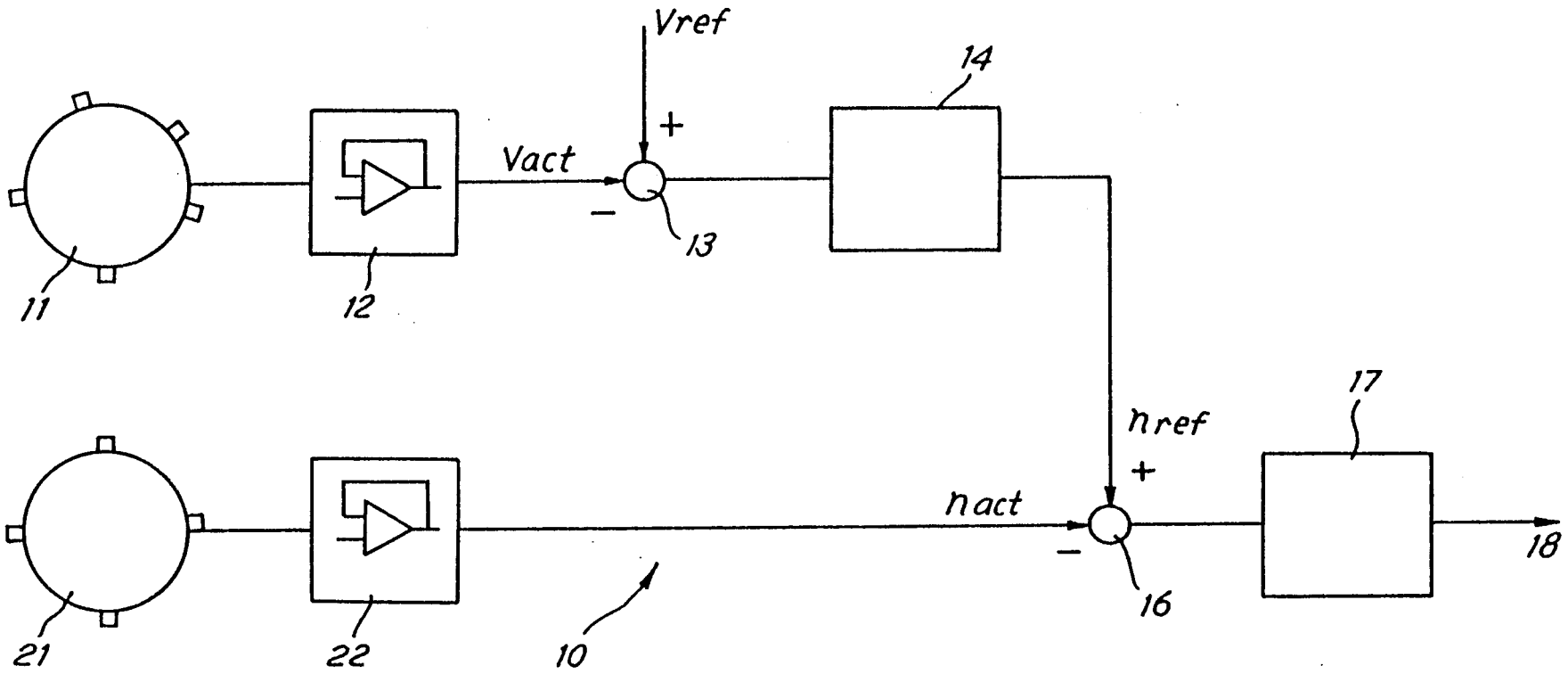
Vref
+
13
-
Vact
12
11
14
nref
+
16
-
nact
22
21
17
18
10

SYSTEM AND METHOD FOR CONTROLLING THE SPEED OF A VEHICLE HAVING AN INTERNAL COMBUSTION ENGINE

FIELD OF THE INVENTION

The present invention relates to an arrangement and method for speed control, and more particularly to controlling the amount of fuel or air supplied to the internal combustion engine of a motor vehicle to adjust the vehicle speed to a predetermined value.

BACKGROUND OF THE INVENTION

It is known, for example from U.S. Pat. No. 4,747,051 to compare desired and actual values of the vehicle speed and to use the result of the comparison to control, via a PI-controller, the amount of fuel supplied to the engine by appropriate adjustable supply means. Such arrangements suffer from a number of disadvantages. For example, the means for sensing the actual road speed is frequently inaccurate. Moreover, the actual vehicle speed changes only relatively slowly in response to changes in the amount of fuel supplied.

SUMMARY OF THE INVENTION

According to a first aspect of the present invention, there is provided a system for controlling the speed of a vehicle with an internal combustion engine, the system comprising means for sensing the actual speed of the vehicle, means for comparing the actual speed signal with a desired speed signal, and control means responsive to the output of the comparing means to control a fuel supply means to the engine, characterised in that the system further comprises means for sensing the speed of the engine, and in that the control means comprises a first controller, a comparator which compares the outputs of the engine speed sensing means and the first controller, and a second controller responsive to the output of the comparator to effect the control of the fuel supply means.

An advantage of this arrangement is quicker and more accurate control of the fuel supply means and hence the speed.

The control means may control the amount of fuel and/or the amount of air supplied to the engine.

According to a second aspect of the present invention, there is provided a method of controlling the speed of a vehicle with an internal combustion engine comprising comparing the actual vehicle speed with a desired vehicle speed, comparing the actual engine speed with a signal dependent on the result of the first comparison and supplying an amount of fuel and/or air to the engine determined by the result of the second comparison.

BRIEF DESCRIPTION OF THE DRAWING

A preferred embodiment of the present invention will now be described, by way of example only, with reference to the accompanying drawing which shows a fuel supply control system 10 for a vehicle with an internal combustion engine.

DESCRIPTION OF THE PREFERRED EMBODIMENTS OF THE INVENTION

System 10 comprises a vehicle speed sensor 11, for example a speedometer, and an associated circuit 12 evaluating the output of sensor 11. The output Vact of circuit 12 is supplied as an actual vehicle speed signal to an input of a summer or comparator circuit 13 where it is compared with a desired speed signal Vref. The output of comparator 13 is supplied to a vehicle speed controller 14. Instead of representing a desired amount of fuel, the output of controller 14 here represents a desired engine speed signal $\eta_{ref}$. Controller 14 provides the required accuracy with no control deviation; thus a PI-controller is preferably employed.

System 10 also comprises an engine speed sensor 21, for example a tachometer or revolution counter, and an associated circuit 22 evaluating the output thereof. The output $\eta_{act}$ of circuit 22 is supplied as an actual engine speed signal to a summer or comparator circuit 16 where it is compared with the desired engine speed signal $\eta_{ref}$. The output of comparator 16 is supplied to an engine speed controller 17 the output 18 of which controls the amount of fuel injected or otherwise supplied to the internal combustion engine of the vehicle. Controller 17 holds to the desired engine speed determined by controller 14. Controller 17 is responsible for the dynamic behaviour; accordingly a PD-controller is preferably employed.

An advantage of the subordinated or auxiliary engine speed controller 17 is improved stability of the vehicle speed control. The engine speed signal reacts more quickly upon the fuel supply control signal. Furthermore, engine speed sensors are usually more accurate than vehicle speed sensors.

In modifications, the output of controller 17 may additionally or alternatively control the amount of air supplied to the engine.

What is claimed is:

1. A system for controlling the speed of a vehicle with an internal combustion engine, the system comprising:

first sensor means for sensing the actual speed of the vehicle and supplying a first sensor signal indicative of said actual speed;

first comparator means for comparing said first sensor signal to a first desired signal indicative of a desired speed of the vehicle and producing a first comparator signal;

a PI-controller for receiving said first comparator signal and for supplying a first control signal representing a desired engine speed;

second sensor means for sensing the actual speed of the engine and supplying a second sensor signal indicative of the actual engine speed;

second comparator means for comparing said second sensor signal to said first control signal to produce a second comparator signal; and, a PD-controller for receiving said second comparator signal and producing an output for controlling the amount of fuel supplied to the engine.

* * * * *